United States Patent [19]

Iwata

[11] 4,194,932

[45] Mar. 25, 1980

[54] FE/CR/CO PERMANENT MAGNETIC ALLOYS AND METHOD OF PRODUCTION THEREOF

[75] Inventor: Masao Iwata, Chichibu, Japan

[73] Assignee: Hitachi Metals, Japan

[21] Appl. No.: 875,791

[22] Filed: Feb. 7, 1978

[30] Foreign Application Priority Data

Feb. 10, 1977 [JP] Japan ..... 52-12979

[51] Int. Cl.[2] ..... H01F 1/04

[52] U.S. Cl. ..... 148/102; 148/31.57; 148/103

[58] Field of Search ..... 148/108, 121, 102, 103, 148/31.55, 31.57

[56] References Cited

U.S. PATENT DOCUMENTS

| | | | |
|---|---|---|---|
| 3,806,336 | 4/1974 | Kaneko et al. | 45/122 |
| 3,982,972 | 9/1976 | Iwata et al. | 148/31.55 |
| 3,989,556 | 11/1976 | Iwata et al. | 148/31.55 |
| 4,093,477 | 6/1978 | Iwata et al. | 148/108 |

OTHER PUBLICATIONS

Kaneko et al. "Effect of V and V+tTi Additions on the Structure and Properties of Fe-Cr-Co Ductile Magnetic Alloys," IEEE Trans. on Mag., vol. Mag. 12, No. 6 pp. 977-979, 11/76.

*Primary Examiner*—Arthur J. Steiner
*Attorney, Agent, or Firm*—Craig and Antonelli

[57] ABSTRACT

Fe/Cr/Co alloys of this invention which are provided with both a good workability and maximum energy product of 2.0 MGOe or more, consist of 17 to 45% by weight of chromium, 3 to 14.9% by weight of cobalt and the remainder being essentially of iron, which also attribute to the method of producing improved Fe/Cr-/Co permanent alloy products usable with good efficiency on an industrial scale and make the best possible use of the advantageous characteristics particular to the component compositions of the alloys. This method contains the aging in a magnetic field and preferably comprises at least the step of aging in a magnetic field the alloy material in a predetermined temperature range and the secondary aging treatment step of cooling continuously and gradually the alloy material through a predetermined temperature range.

14 Claims, 7 Drawing Figures

FE/CR/CO PERMANENT MAGNETIC ALLOYS AND METHOD OF PRODUCTION THEREOF

BRIEF SUMMARY OF THE INVENTION

The present invention relates, in one feature, to an improved permanent magnet alloy product having iron, chromium, and cobalt contents as main constituents, and particularly is directed to minimizing the natural resources to be involved, containing as little cobalt as possible, thus providing a good workability, and having a maximum number of the advantageous characteristics particular to the composition of the alloys. This invention also relates, in another feature, to an improved method of producing Fe/Cr/Co magnet alloys of the character stated above, and more particularly to an improved method of producing such magnet alloy which can be practiced with a high efficiency on an industrial scale and whereby the advantageous characteristics particular to the component constituents used in the production of the alloys can be obtained at a maximum level.

Many magnet alloys comprising as main component constituents iron, chromium and cobalt have been commonly known from many public literatures and papers. For instance, in Japanese Patent Publication No. 20451/1974, there is disclosed such a magnet composition containing 15 to 30% by weight of cobalt, 3 to 50% by weight of chromium and the remainder being essentially of iron. In Japanese Patent Publication No. 29859/1976 is disclosed a magnetic alloy containing 20 to 35% by weight of chromium, 10 to 20% by weight of cobalt, 0.3 to 3% by weight of titanium and the remainder being essentially of iron, and Japanese Patent Laid-Open Publication No. 123113/1974 discloses a magnet alloy consisting of 17 to 35% by weight of chromium, 5 to 20% by weight of cobalt, 0.3 to 3% of silicon by weight, and the remainder being essentially if iron.

On the other hand, with respect to the prior processes of producing such Fe/Cr/Co magnet alloys, for instance, there are such disclosures as Japanese Patent Publication No. 20451/1974 which comprises the steps of subjecting an obtained alloy to solution treatment after melting and casting operations, and conducting ageing treatment on the thus solution treated alloy in a magnetic field, thereafter subjecting it to ageing, Japanese Patent Publication No. 37011/1975 is characterized by the steps of conducting ageing treatment on the product in the presence of a magnetic field after the solution treatment, and subjecting it to cold working, thereafter subjecting it to a multi-stage ageing treatment.

Also, in Japanese Patent Laid-Open Publication No. 52318/1976, there is disclosed the solution treatment method characterized by the step of maintaining the alloy material in a temperature range from 650 up to and inclusive 1085° C. for a time period of 3 to 300 minutes, while in the Japanese Patent Publication No. 38224/1976 is disclosed the process characterized by the step, as the treatment procedure in a cold plastic working step, of maintaining the alloy at the temperature range of from 850 up to and inclusive of 1085° C. for a time period of 3 to 300 minutes.

In the Japanese Patent Laid-Open Publication No. 79631/1976, there is disclosed a method of ageing treatment characterized by the step of continuously and slowly cooling the alloy at such a slow cooling rate as 5 minutes to 50 hours/10° C. throughout at least 10° C.

of temperature unit from an optical temperature in the range of 700° to 400° C.

As a further example, in the periodical publication entitled "IEEE Transactions on Magnetics," Vol. MAG-12, No. 6, pp 977 to 979 (issued by the American Institute of Electrical and Electronical Engineers in November, 1976), there is disclosed a method of heat treatment which comprises the steps of maintaining an alloy at a predetermined temperature in a magnetic field, then cooling it down to an ambient temperature, thereafter conducting a secondary ageing treatment by way of a multistage ageing system without any magnetic field, and an other method comprising the steps of maintaining an alloy material at a given temperature, thereafter providing continuous and gradual ageing treatment on it from the above mentioned temperature level without applying any magnetic field.

In the conventional production process of multicomponent magnet alloys containing iron, chromium and cobalt as main component, it has been general practice to form such alloy material to a desired shape through the serial processes of melting, casting, hot working, cold working, etc., and of conducting a solution treatment either sometime during such series of processing, if necessary, or after such process, and then finally subjecting it to be ageing treatment, thus effecting magnetic hardening of the alloy material.

As stated hereinbefore, there are many public literatures and papers with respect to magnet alloys having main components of iron, chromium and cobalt, and according to continuous efforts in research and development of these types of magnet alloys, there have been proposed approaches for accomplishing improvement in the properties of such alloys and also rationalization in the manufacture thereof. Further, these types of magnetic alloy have been and are finding their prospective uses increasingly in extensive fields of application. As for the objects to be aimed at in view of the fact that today's resources conservation movement throughout the world, it is very earnestly desired to particularly limit the cobalt content in such magnetic alloys, but still obtain a further improvement in the magnetic properties obtainable from such alloys and to establish a further stabilized as well as more simplified heat treatment operation in the magnetization of such alloys, and the like.

It is therefore a primary object of the present invention to provide an improved Fe/Cr/Co magnetic alloy having as low a cobalt content as possible, yet providing magnetic properties as high as possible.

It is another object of this invention to provide an improved method of producing such magnetic alloy whereby the magnet properties of such alloy can be made excellent, and the manufacture of such alloy may be done with high efficiency on an industrial scale.

Fe/Cr/Co magnet alloy according to this invention consists of 17 to 45% by weight of chromium, 3 to 15% by weight of cobalt, and the remainder being essentially of iron. It is a known fact in the art that with less chromium and cobalt contents than the above mentioned limits, it becomes difficult to attain satisfactory coercive force in practice. While, if the chromium content is more than 45%, the workability of such alloys would become poor, and the remanent magnetic flux density thereof would also become smaller. With respect to a cobalt content in the alloys, it is apparently preferable to keep it as low as possible, i.e., about 10% or less, but from the standpoint of attaining a coercive force as high as possible, a preferable range should be within 10.6 to 14.9% by weight. Should the cobalt content exceed a level of 15%, the conditions for a solution treatment would become increasingly severer, and at the same time it would become more difficult to attain a desirable residual magnetic flux density, and a good workability as well. In this respect, it is preferable to use an alloy having a cobalt content of 15% or less particularly for magnets undergoing deep drawing or the like. When the cobalt content is higher than level of 35% in an alloy, it is known that the residual magnetic flux density would become considerably lower as a permanent magnet.

It is preferable that a solution treatment be applied particularly to a material which is to be cold-worked, while in a material which is to be subjected to a hot working only and has little or no residual strain due to the working, it is recommendable, in view of the material's properties, to apply an ageing treatment thereto without any solution treatment. It is preferable, when necessary, to practice the solution treatment by maintaining the material at a temperature ranging from 650° to 1085° C. for a time period of 3 to 300 minutes as specified in the Japanese Patent Laid-Open Publication No. 52318/1976, the inventor of which is the same as that of the present application.

The ageing treatment as stated above is a practical step to performing hardening of a magnetic composition of matter or alloy, which is a significant step that would render a critical influence on the magnetic properties of alloy products. This particular process of ageing treatment is an important step, as fully disclosed by the inventor in the Japanese Patent Laid-Open Publication No. 79631/1976 who is the same inventor as that of the present invention, and it should preferably be practiced in such a manner to cool the material from any optional temperature level in the range of 700° to 400° C. continuously and gradually at such a cooling rate that a temperature drop of 10° C. is obtained in a time period of from 5 minutes to 50 hours at least throughout a temperature unit of 10° C. Particularly, during that cooling procedure, the continuous and gradual cooling of the material through the temperature range of 650° to 450° C., particularly 600° to 500° C., brings an outstanding effect on the improvement of the magnetic properties of the product. In order to obtain uniformity of the properties of the product, it is preferred to conduct the following alternative steps of processing, i.e., 1) maintaining the material at a predetermined constant temperature level for a sufficiently long period, then subjecting thus treated material to a continuous and gradual cooling procedure as mentioned above; 2) maintaining the material at a predetermined constant temperature for a given period of time, then cooling the material in a normal cooling manner down to near the ambient temperature, thereafter reheating the thus cooled material and applying the continuous and gradual cooling treatment as stated above, or 3) selectively varying the cooling rate of the continuous slow cooling operation with each temperature unit or zone within the temperature range.

According to this invention, by one aspect thereof, briefly summarized by way of a preferred embodiment thereof, there is provided an improved magnet alloy having a content of iron, chromium and cobalt as the essential compositions thereto, consisting of 17 to 45% by weight of cobalt and the remainder being essentially of iron, and aged in the presence of a controlled magnetic field thereby to provide a maximum energy produce of 2.0 MGOe or more.

Also, according to this invention, in another aspect thereof, briefly summarized by way of a preferred embodiment thereof, there is provided an improved method of producing the alloy product of the character stated above, which comprises a primary magnetic ageing treatment step of maintaining the alloy at a predetermined temperature level in the presence of a magnetic field, thereby magnetically controlling the formation of the structure of the magnetic alloy along the orientation of the magnetic field, and a secondary ageing treatment step of thereafter cooling continuously and gradually the alloy through a temperature range collectively lower than the temperature level in the primary magnetic ageing treatment step without the effect of the magnetic field, thereby aligning the orientation of the metal structure formed in the primary magnetic ageing treatment step. Then it is necessitated that the step of cooling, upon the completion of the magnetic ageing treatment step, down to a predetermined initial temperature level of the secondary ageing treatment would be performed at a fast cooling rate.

BRIEF DESCRIPTION OF THE SEVERAL VIEWS OF THE DRAWING

The objects, principles, and details of the present invention, as well as other objects and advantages thereof, will become more apparent from the following detailed description with respect to a preferred embodiment of the invention, when read in conjunction with the accompanying drawing, in which.

DETAILED DESCRIPTION OF THE INVENTION

The present invention was materialized essentially through the inventor's deliberate studies on the ageing treatment stated hereinbefore. In this consideration, description will now be given in detail for a better understanding of the present invention from the standpoint of a metallographic approach.

Under the effect of an ageing treatment, an Fe/Cr/Co magnet alloy is caused to be separated from a homogeneous solid solution (hereinafter referred to as "$\alpha$ phase") into two phases, i.e., a ferromagnetic phase (hereinafter referred to as "$\alpha_1$ phase") and a non-ferromagnetic or inferior ferromagnetic phase (hereinafter referred to as "$\alpha_2$ phase").

Although it is not yet been completely confirmed in the exact sense from a metallographical view, it is considered that the $\alpha_1$ phase is possibly a phase mainly constituted of Fe, and the $\alpha_2$ is a phase mainly constituted by Cr and Co.

Figure 1:
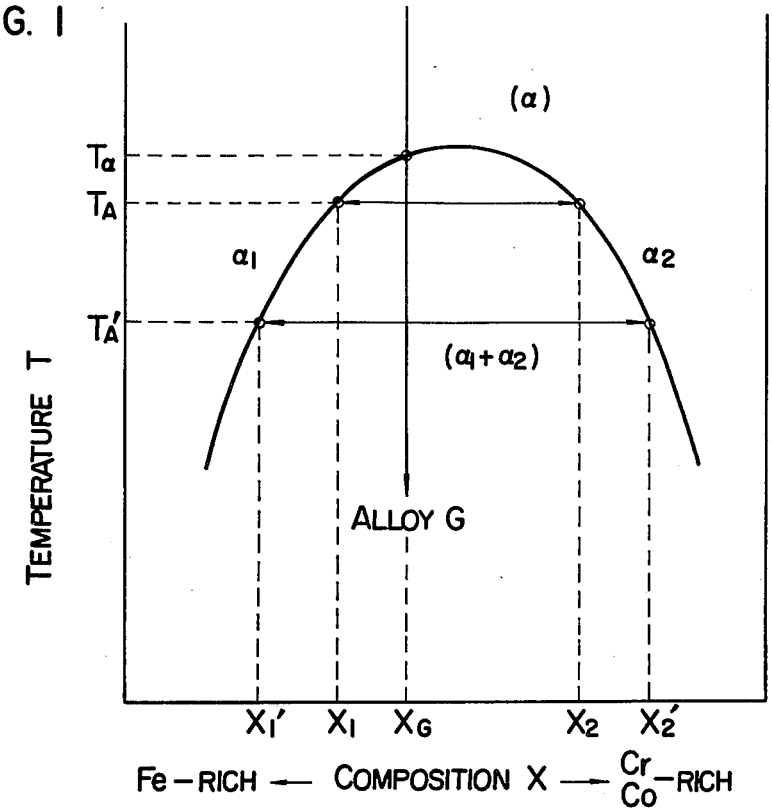
FIG. 1 is a schematic phase diagram of Fe/Cr/Co alloy.

FIG. 1 is a schematic phase diagram qualitatively showing the state of phase distribution of the two phases. Referring to FIG. 1, the compositions of the Fe/Cr/Co magnet alloy system are, for instance, shown with the value of XG's on the abscissa of the coordinates, and therefore, according to the schematic diagram, this alloy G is a single $\alpha$ phase at a higher temperature, while when the alloy G is subjected to ageing treatment at a temperature, for instance, of $T_A$, lower than a two-phase separation or the spinodal dissociation temperature Td, the alloy G is separated into two phases, i.e., $\alpha_1$ of composition $X_1$, and $\alpha_2$ of composition $X_2$.

Figure 2:
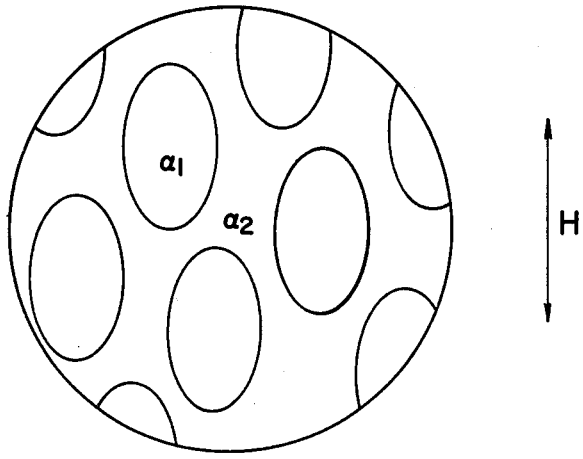
FIG. 2 is a graph showing the state of the precipitation of $\alpha_1$ and $\alpha_2$ phases in the magnet alloy according to the present invention.

If the ageing temperature changes, there occurs a difference in the compositions of each phase to be separated, for instance, when the alloy G is subjected to an ageing treatment at a temperature $T_A'$, the alloy is now separated into two phases; i.e., $\alpha_1$ of a composition $X'_1$ and $\alpha_2$ of a composition $X'_2$. As to the case of the present Fe/Cr/Co magnet alloy, as typically shown in FIG. 2, it is known that the $\alpha_1$ phase appears as an elongated grain, and consequently, it has a shape-oriented magnetic crystal anisotropy wherein the orientation of each elongated grain coincides with a direction of easy magnetization, and due to its extremely fine grain size and hence its behaviour as a single magnetic domain particle, there is generated an Hc effect by the mechanism as explained according to the principle of Stoner and Wohltarth, thus resulting in excellent permanent magnetic properties. By virtue of such magnetic hardening mechanism as stated above, the magnetic properties of the alloy according to this invention is essentially dependent upon geometrical factor of the two-phase separated structure (i.e., grain configuration, grain size, volumetric ratio of the two phases, etc.) as well as a value of saturated magnetization of each of thus separated two phases (consequently, composition of the two component phases). Now, description is given further on the desirable conditions wherein the present Fe/Cr/Co magnet alloy can display excellent magnetic properties. The requirement for the grain size of the $\alpha_1$ phase of the alloy is such that it should not be too coarse in view of the necessity that it must act in the manner of a single domain particle, and on the other hand, it should not be too fine as it is not desired that it may behave in a super paramagnetic manner. In this respect, it is desirable that the $\alpha_2$ phase be of ferromagnetic grain having a size in the order ranging from about several hundreds through several thousands of angstrom. In order to meet the requirements for as excellent a permanent magnet product, it is essentially required that each $\alpha_1$ grain should have a magnetic crystal anisotropy as great as possible and also $\alpha_1$ grains should have uniform equal magnetic crystal anisotropy as a whole, namely, each grain should have the same orientation and the same value of magnetic crystal anisotropy. The magnetic anisotropy of each $\alpha_1$ phase is essentially attributable to its anisotropical shape, and therefore, in order to have a greater magnetic anisotropy in an alloy system, it is essential to satisfy two conditions, i.e., each particle in the $\alpha_1$ phase should be elongated as much as possible along its crystal orientation, and there should be a difference as large as possible in the values of saturated magnetization between $\alpha_1$ and $\alpha_2$ phases, i.e., $\alpha_1$ phase should be of a ferromagnetism as large as possible, while $\alpha_2$ is of a non-ferromagnetism or of a preferably less ferromagnetism. In order to meet the latter condition, it is essential that a difference between the compositions of the two component $\alpha_1$ and $\alpha_2$ phases be as large as possible. In a magnetic ageing treatment on the alloy system, each $\alpha_1$ grain tends to grow longer and all $\alpha_1$ grains are elongated along the direction of the magnetic field, there occurs an effect of alignment in the anisotropy of such $\alpha_1$ grain as a whole, therefore, this will contribute essentially to the improvement of magnetic properties of a magnet product.

With respect to a volumetric ratio between the two phases, if there are observed too little formation of $\alpha_1$ phase in the alloy structure, a value of saturated magnetization will become smaller as a whole, while formation of an excessive amount of such $\alpha_1$ phase, there will occur magnetic interaction between $\alpha_1$ phases, resulting in a decrease in the magnetic crystal anisotropy of the alloy, and each $\alpha_1$ grain being unable to act like a single magnetic domain particle. In this respect, both cases turn out to be objectionable for the purpose of obtaining excellent magnetic properties. In general, it is preferred that the value of volumetric ratio between $\alpha_1$ and $\alpha_2$ phases turn out to be 50%:50%, approximately.

As fully discussed above, since each factor which would affect magnetic properties of a magnet vary greatly in various ways with given heat treatment conditions of an ageing treatment, the thus obtained magnetic properties will change extensively depending on the given ageing treating conditions. Among such factors, the above mentioned geometric factor has a particularly high dependency upon the ageing conditions in a relatively high temperature range of the ageing treatment. In other words, at a temperature range higher than the point of two-phase separation Td shown in FIG. 1, as there takes place no two-phase separation in an ageing treatment of the alloy, being left to be still in a single phase, there is observed little extent of Hc. At a temperature immediately below the point Td, due to the nucleation and growth mechanism of precipitation, there are formed spherical precipitates, which will possibly turn out to be a coarsegrained structure generally due to the effect of surface energy of thus-formed precipitates, the higher the ageing temperature is, and the longer the ageing period of time. The thus obtained structure would not bring forth any excellent magnetic properties in a product because of its lower anisotropy in each grain, or irregularity in its magnetic anisotropy and orientation as a whole. If an ageing treatment is conducted at a lower ageing temperature than the so-called spinodal temperature Ts defined in the thermodynamics, (which is necessarily lower than the point Td), there takes place a two-phase separation due to the spinodal dissociation mechanism, thus forming a transformed structure. The thus formed structure is of a regular structure, and each grain is of a certain degree of anisotropy in its shape. If the size of such particles is in an appropriate range, there is obtained a magnet product having fairly excellent properties. As the size of the thus formed transformed structure is proportional to the value of $1/\sqrt{\Delta T}$, where $\Delta T$ represents a difference between the ageing temperature and the spinodal temperature (Ts), thus $\Delta T = Ts - TA$; TA represents an ageing temperature ($<Ts$). From this, there is formed a structure of coarser grains as the ageing temperature increases. As the value $\Delta T$ is a denominator in the above equation, when the value $\Delta T \approx 0$, that is, the ageing temperature level is relatively high and approximately equals to the spinodal temperature, the size of the transformed structure of the alloy is now known to be dependent positively upon the ageing temperature. In contrast, when the ageing temperature is relatively low, there is formed a transformed structure having fine grain size. However, it is known that the size of the thus formed grain does not vary so much with a given ageing temperature.

In an ageing treatment with a relatively high temperature, the two-phase separation mechanism per se is essentially of such a complexity as mentioned above, but also the rate of the diffusion of atoms is large in such two-phase separation. Consequently, as stated hereinbefore, there is a high dependency on the geometric factor upon the ageing treatment conditions. In this consideration, in order to obtain an ideal metal structure for use in an excellent permanent magnet product, it is essential to exercise particular cautions in that particular stage of heat treatment so as to obtain an optimized controlling condition. The significance of applying a magnetic field during heat treatment procedures resides in the provision of increased demagnetizing energy of the $\alpha_1$ grain extending in a variety of orientations so as to prevent an elongating trend thereof. It is therefore at this particular stage where it is possible to greatly vary the geometric factor that the effect of applying a magnetic field during a heat treatment operation becomes so distinct.

On the other hand, the difference between the saturated magnetization values of each of two phase separated as stated above is proportional to the compositions of the alloy. Therefore, as seen from FIG. 1, this particular difference value becomes smaller when a higher ageing temperature is used. In this consideration, with all the structure separated into two phases having desirable geometric factors due to an ageing condition at the relatively high temperature as stated hereinbefore, if it is left untreated further in any suitable manner, there are obtained no excellent magnetic properties attributable to small differences in the saturated magnetization values between the two phases. From this, it seems preferable to select a relatively low ageing temperature, however, due to the fact that the rate of the reaction caused by the ageing treatment would turn out to be substantially slow such a relatively low temperature aging is simply conducted and that the grains of the phases to be separated into two phases would become too small, thus would result in only poor magnetic properties. The key to the establishment of an optimum ageing treatment for bringing a magnet product of excellent magnetic properties resides eventually in finding out the conditions in which said seemingly contradictory two problems can be compromised with each other in the best manner. For solving this problem, there have been proposed multistage ageing systems which comprise the steps of firstly applying an ageing treatment at a relatively high temperature so as to obtain a separated two-phase structure corresponding to that temperature, thereafter repeating a further ageing treatment or treatments at a relatively low temperature thereby to widen the difference of the compositions in the two phases. Among them, one of the most efficient processes is rather to provide a method for changing the aforesaid stepwise ageing into a more smooth and continuous cooling ageing so as to maintain equilibrium conditions at each temperature while gradually lowering the temperature, as is disclosed in the Japanese Patent Laid-Open Application No. 79631/1976 of the present invention.

In such ageing treatment, it is observed that once a two-phase structure has been formed at the initial stage, namely at a relatively high temperature range, there progresses a replacement of atoms between two phases which can be done by a short range atomic movement, namely, widening of the composition difference, including the secondary or following ageing treatment, yet little progress takes place such as reaction changing the micro structure wherein an atomic movement over a relatively long range is required. 'Actually, although magnetic properties are improved to a remarkable extent as the secondary ageing treatment proceeds, it is known through electron microscope observation that thus formed two-phase separated structure does not vary substantially throughout the processing.

As stated hereinbefore, in order to obtain the improvement in the magnetic properties of the ternary Fe/Cr/Co magnet alloy according to this invention, the provision of a continuous and slow cooling system during an ageing operation and the introduction of a magnetic ageing treatment system is very efficient. As is apparent from the foregoing explanation, it is important that the magnetic ageing treatment be provided at the initial stage of ageing or at a relatively high temperature, thereby resulting in a remarkable effect and function. In contrast, an ageing operation at midway of such ageing treatment, namely, during a relatively low temperature range, generally the effect of applying such magnetic ageing treatment turns out to be less effective. In this respect, in order to assure an improved effect of such magnetic ageing treatment, there have been proposed the following processes, in addition to the provision of such continuous and slow cooling system of, e.g., (1) applying a magnetic field during a slow cooling process at the initial stage thereof; (2) maintaining the alloy at a predetermined temperature in a magnetic field, thereafter continuously applying a gradual cooling process in or without a magnetic field, and (3) maintaining the alloy at a predetermined temperature in a magnetic field, thereafter cooling it down in an ordinary process, reheating the thus once cooled material to a temperature lower than the primary magnetic ageing temperature, then applying a secondary ageing treatment or continuous and slow cooling with or without applying a magnetic field. Such processing has been found to be remarkably useful and advantageous in view of the provision of excellent magnetic properties in comparison with the conventional process without using such a magnetic field. Among these processes, in the past it was publicly known to maintain the alloy at a predetermined temperature in the presence of a magnetic field, thereafter applying a continuous and slow cooling without the effect of magnetic field. In this particular processing, however, since the alloy is subjected to a continuous and slow cooling process in succession after the magnetic ageing operation has been completed, there is inevitably such a transient stage that the alloy temperature lowers down slowly through such a high temperature range where there is still a formation of a separated two-phase structure process without the effect of a magnetic field, thus permitting a random two-phase separated structure without being subjected to the effect of a magnetic field to be formed together with a two-phase separated structure which has been desirably restricted in its orientation under the effect of the magnetic field. Consequently, a maximum effect in magnetic properties which is inherently in the alloy has not sufficiently been obtained.

As is readily understandable from the foregoing discussion repeatedly explained hereinbefore, in such ageing treatment in the magnetic field, it is one of the essential requirements for obtaining excellent magnetic properties to prevent as much as possible a secondary two-phase separation from being formed after stopping the application of a magnetic field.

The invention is essentially intended to provide an improved method of producing an Fe/Cr/Co magnet alloy that is advantageously designed to meet the above mentioned requirements in the ageing treatment of the magnet alloy.

That is, according to the present invention, there is provided an improved method of producing an Fe/Cr-/Co magnet alloy of excellent magnetic properties which is characterized by a combination of separated two step ageing treatments comprising, a primary ageing treating step of maintaining an alloy having the compositions according to this invention at a predetermined constant temperature in a controlled magnetic field so as to produce a two-phase separated structure with its crystal anisotropy in one constituent phase being well oriented along the direction of the applied magnetic field and thereafter a secondary ageing treating step of conducting continuous and slow cooling procedure at a predetermined temperature range which is lower than that in the primary magnetic ageing treatment thereby to widen the difference developed in the component compositions between thus separated two phases, the treating temperature of the latter step being selected to be within such a relatively low temperature range that there is developed little or no further two-phase separation, furthermore upon completion of the former step, the alloy must quickly be cooled to a level at least lower than the starting temperature of the latter secondary ageing treatment, whereby any undesirable trend of developing a further two-phase separation of the alloy being under the effect of the controlled magnetic field is effectively prevented.

In such treatment as stated above, a controlled intensity of a magnetic field sufficient to provide a minimum desired effect in the magnetic ageing treatment is found to be approximately 500 Oe, and 1000 Oe or more if sufficient effect is desired, and preferably be 2500 Oe or more, or more preferably be more than 4000 Oe.

On the other hand, the temperature range where there is expected an efficient magnetic field ageing effect, which partly depends upon the compositions of the magnetic alloy to be treated, is known to be in the range from 570° to 700° C., and particularly, the range of 590° to 670° C., more particularly, 610° to 650° C. is found to be most efficient in such magnetic ageing effect. The relationship between the ageing temperature and the magnetic intensity is typically shown in FIG. 3 covering the temperature range stated above.

Figure 3:
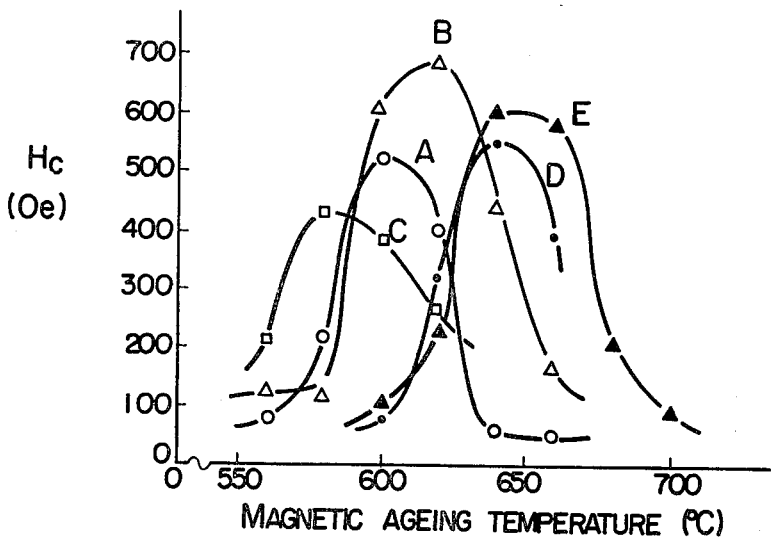
FIG. 3 is a graph showing the relationship between the magnetic ageing temperature and the coercive force Hc of the magnet alloy.

FIG. 3 is obtained from a series of experiments conducted on the following conditions. Specimens of five test alloys having the following compositions were prepared; i.e., Sample A containing 30% Cr by weight (applicable to all other components), 10% Co, 1.5% Si, and the remainder being essentially of Fe; Sample B of 30% Cr, 14% Co, 1.5% Si, the remainder being essentially of Fe; Sample C of 35% Cr, 8% Co, 2.5% Si and the remainder essentially Fe; Sample D of 24% Cr, 12% Co, 0.5% Si, and the remainder being essentially of Fe; and Sample E of 24% Cr, 14% Co, 1.3% Si, and the remainder being essentially of Fe. The specimens were cut into test plates each having the dimensions: 2 mm×10 mm×30 mm, and solution treated at the temperature of 1300° C. for a period of 10 minutes. The thus prepared specimens were subjected to a series of magnetic ageing treatment conducted in a magnetic field of 4000 Oe intensity and at various temperatures and kept thus for a period of one hour. The application of such magnetic field was begun when the specimen temperature reached 550° C., and after the tests were over, the specimens were taken out of the furnace and left to naturally cool.

As the step of secondary ageing treatment, Speciment A was reheated to 580° C. without the effect of a magnetic field, then the continuous and slow cooling step was conducted on the specimen down to 480° C. at such a cooling rate that there was obtained a decrement in temperature of 100° C. with the lapse of 16 hours. After such step was over, the specimens were taken out of the furnace and left to naturally cool. With respect to Specimens B, C, D and E, there were provided the secondary ageing steps wherein the continuous and gradual cooling was conducted through the following temperature ranges of, 600° down to 500° C., 560° to 460° C., 620° to 500° C., 620° to 500° C., respectively, and for an equal cooling rate, i.e., a decrement in temperature of 100° C. was obtained with the lapse of 16 hours. The relationship between the magnetic ageing treatment temperature and thus obtained coercive force Hc is as shown in FIG. 3.

Figure 4:
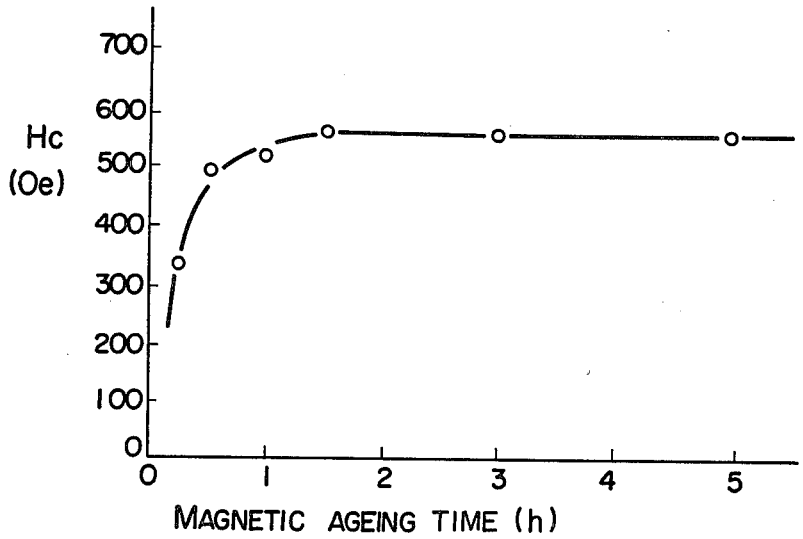
FIG. 4 is a graph showing the relationship between the magnetic ageing time and Hc of the magnetic alloy.

On the other hand, the relationship between the holding time h and the coercive force Hc is as shown in FIG. 4 where Specimen A was heated to 600° C. and held for scheduled varied periods of time. As is apparent from FIG. 4, it will be observed that a coercive force of 300 Oe or more is obtainable with the magnetic ageing treatment held for a period of about 10 minutes or more, however, it is preferable, in order to obtain a magnet product having superior magnetic properties, that such magnetic ageing treatment be held for the time period of 30 minutes or longer, more preferably further extended to 1 hour or longer.

When applying the secondary ageing treatment by way of the continuous and slow cooling procedure according to this invention, it is preferable for obtaining the excellent magnetic properties that the initial temperature for starting the secondary ageing treating step be lower by 5° to 100° C. than the first magnetic ageing treatment temperature, and particularly that this effect be enhanced if the temperature is lower by 10° to 80° C., more preferably by 15° to 60° C. than the first ageing temperature. It was also found preferable that the end temperature of the secondary ageing treatment be 500° C. or lower, more preferably be 480° C. or lower, while a still acceptable effect was observed as well with the temperature of 520° C. or lower. These facts are typically shown in FIGS. 5 and 6, and as obtained by the following experiments.

Figure 5:
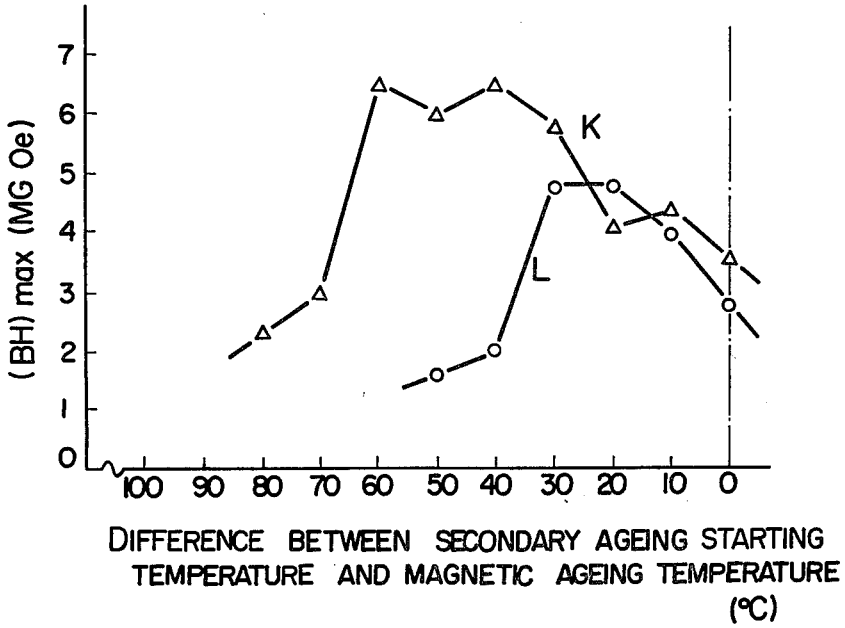
FIG. 5 is a graph showing the influence rendered by the difference between the secondary ageing starting temperature and the magnetic field ageing temperature upon the (BH) max. value of the magnet product.

Another series of experiments were conducted by using Specimen K having the compositions of 24% by weight (applicable to all others) Cr, 12% Co, 1.3% Si and the remainder essentially of Fe, and Specimen L of 30% Cr, 10% Co, 0.5% Si and the remainder essentially of Fe; these were cut into test plates with dimensions of 2 mm×10 mm×30 mm. The specimens were prepared by subjecting them to solution treatment at 1300° C. for a period of 10 minutes. The thus obtained specimens were subjected to primary magnetic ageing treatment wherein Specimen K was heated to 650° C. and Specimen L was heated to 630° C. and both were held for a period of one hour in a magnetic field of 4000 Oe by intensity. As for the secondary ageing step, the specimens were reheated, without effecting any magnetic force, to temperature lower than those at the above mentioned primary magnetic ageing treatment, then from these temperatures they were cooled down continuously and slowly to 450° C. with such a cooling rate that a decrement in temperature of 100° C. was obtained over a period of 16 hours. After such treatment, the specimens were taken out of the furnace and left to naturally cool to room temperature. The relationship between the initial secondary ageing temperature and the obtained maximum energy product (BH) max. from such treatment is as shown in FIG. 5. For convenience, in FIG. 5 the difference between the starting temperature of secondary ageing treatment and the primary magnetic ageing temperature is shown on the abscissa of the coordinates.

Figure 6:
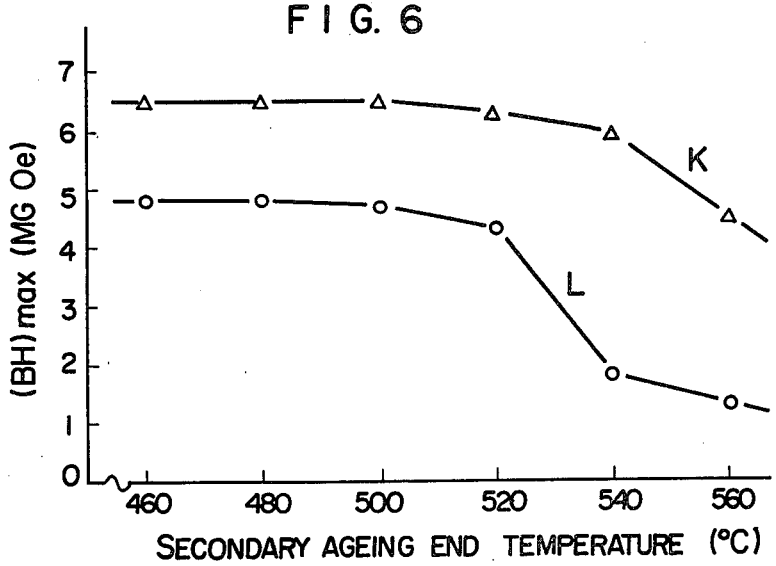
FIG. 6 is a graph showing the relationship between the secondary ageing temperature and the (BH) max. value of a magnetic product.

As for the secondary ageing treatment of somewhat lower temperatures of these two specimens, specimen K was reheated to 590° C. and Specimen L to 610° C., and from such temperatures they were cooled down in continuous and slow cooling step at such a cooling rate providing a decrement of 100° C. over a period of 16 hours down to the varied end temperatures, thereafter taken out of the furnace and left to naturally cool. The relationship between these varied end temperatures and the maximum energy product (BH) max. thus obtained is shown in FIG. 6.

Figure 7:
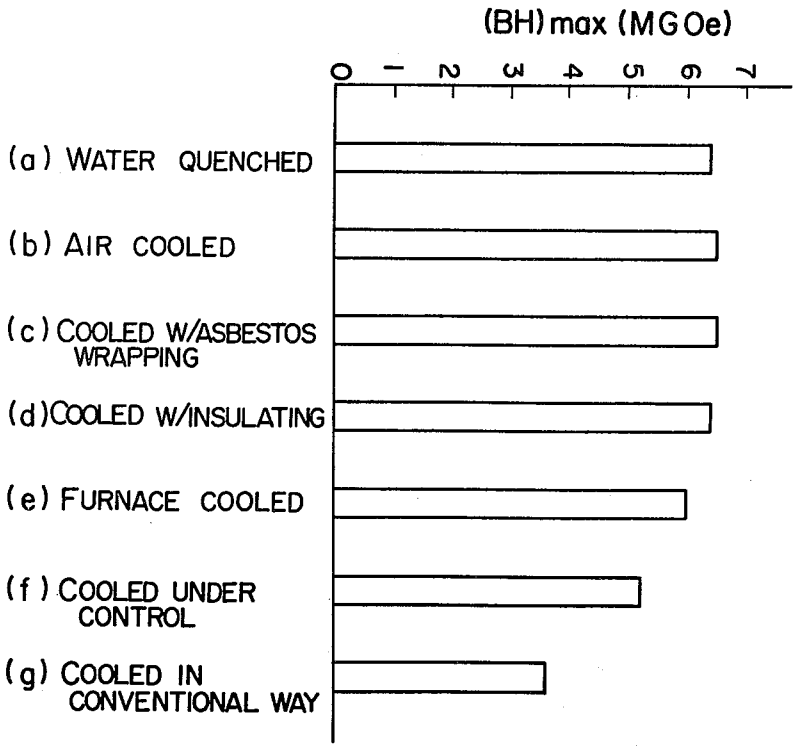
FIG. 7 is a graph showing the relationship between the types of cooling taken after a magnetic field ageing treatment and the (BH) max. value of the magnetic product.

Now, with respect to the cooling rate where the specimen is quickly cooled down after the magnetic ageing treatment according to this invention, as fully discussed hereinbefore, it can be expected to make good use of the advantageous effect of this invention only if this particular cooling rate is faster than that of the secondary ageing treatment, whereby it can be expected to attain the improvement in the magnetic properties. FIG. 7 shows such effect by way of experiments. In the experiment, the above mentioned Specimen K was prepared and treated according to the same manner as stated above. The thus prepared specimen was subjected to a primary magnetic ageing treatment in a magnetic field of 4000 Oe while it was heated to 650° C. and held for a period of 1 hour. After this holding step, the application of the magnetic force was stopped, and at the same time, cooling of the specimen was commenced to cool it down to at least 590° C. or lower by applying the following varied cooling schedule. That is, (a) quenching in water, (b) taking out of the furnace and being left to naturally cool (it took about 1 minute to cool from 650° C. down to 550° C.). Values in the following parentheses show this period of cooling, (c) preliminarily being wrapped around with a sheet of asbestos and subjected to a magnetic ageing treatment, then being taken out of the furnace and left to naturally cool (about 4 min.), (d) preliminarily wrapping the specimen around together with a brass patch designed to increase the weight thereof with fire-proof heat-resisting wires and subjecting the specimen to a magnetic ageing treatment, then being taken out of the furnace with the wrapping and being left to naturally cool (about 30 min.), (e) held within the furnace with the power source off and being left to cool (about 2 hrs.), (f) subjected to a continuous and gradual cooling step down to 570° C. with the cooling rate providing a decremental temperature drop of 100° C. over 6 hours, then being taken out of the furnace and left to naturally cool, (g) subjected to a continuous and slow cooling step down to 500° C. with a decremental temperature drop of 100° C. over 16 hours, then being taken out of the furnace and left to naturally cool.

Following the above mentioned steps, the following step was given to all the specimens other than that prepared according to the Step (g) above. That is, the specimens were reheated to 590° C. (without applying a magnetic field), thereafter they were treated with a continuous and slow cooling procedure from that temperature level down to 500° C. with a rate of temperature decrement of 100° C. over 16 hours. After such treatment, the specimens were taken out of the furnace and left to naturally cool.

Among all the specimens, the methods as depicted in Items (a) through (f) above were made according to the present invention, while the method of Item g) was of the conventional one.

The relationship between the cooling method after the magnetic ageing treatment and thus obtained maximum energy product (BH) max. as appeared in the cases stated above is as shown in FIG. 7. It can be seen from FIG. 7, where the cooling rate after the magnetic ageing treatment is made faster than that of the secondary ageing treatment according to the present invention, that the magnetic properties were improved; it is preferred in view of the practical application to have the cooling rate such that the decremental temperature drop of 100° C. be obtained for the period of 2 hours or less, more preferably within 30 minutes or less. In general, natural cooling is almost sufficient, since there is required no particular equipment or means in practice, and moreover, such natural cooling procedure is sufficient for attaining the advantageous effect of making the magnetic properties of the Fe/Cr/Co magnet alloy excellent according to this invention.

As fully described hereinbefore, it is apparent that a distinct difference can be attained in the advantageous ageing process according to this invention in comparison with the conventional ones. For better understanding of the present invention, the advantageous features of this invention can be summarized as follows, in contrast to the conventional processes.

In the general ageing heat treatment upon Fe/Cr/Co magnet alloy including those carried out in the presence of the magnetic field the conventional methods are such that no concept of continuous and slow cooling was adopted which is one of the most effective processes for an ageing treatment; in other words, a slowing cooling step was conducted subsequent to the magnetic ageing treatment from the prevailing temperature of the preceding step, where the alloy is gradually cooled down through the relatively high temperature range where the reaction of two-phase separation still continues to proceed, thus permitting the formation of an at random or non-oriented two-phase separated structure in the absence of any magnetic field effect together with the orientation-controlled two-phase separated structure. With the above-mentioned arrangement, it has inevitably been impossible to make best use of the excellent magnetic properties which is inherent in thus prepared magnetic alloys. In contrast, according to the present invention, there is now provided an improved process of ageing treatment for an Fe/Cr/Co magnet alloy system which features reside in the step of rapid cooling, upon the completion of the magnetic ageing tratment step down to a predetermined temperature point, thereby to prevent the formation of an at random two-phase separated structure likely to exist in the absence of any magentic field from being formed. This step is so advantageous in the aspect of enabling a best possible effect of the continuous and slow cooling to follow which is known to be most effective for the magnetic ageing treatment on the magnet alloys, so that excellent magnetic properties of the magnet alloys may be well materialized.

With the conventional ageing treatment, a high magnetic efficiency has not been expected from an Fe/Cr-/Co magnet alloy having a small Co content, e.g., with Co content of 15% or less, there was obtained at most the maximum energy product of 1.0 MGOe or less, and with Co content of 10% or less, the maximum energy product has been as low as 0.5 MGOe or less. In contrast, the present invention makes it possible to retard the formation of an uncontrolled two-phase separated structure which tends to form in the absence of a magnetic field; this is accomplished by the provision of the step of quickly cooling down to a predetermined point after the magnetic ageing treatment, and thus making best use of the effect of continuous and slow cooling which is the best ageing treatment process. By virtue of the invention, there is provided the excellent magnetic properties as typically shown in FIGS. 3 through 7 hereto.

On the other hand, as stated hereinbefore, since the geometric factor of the two-phase separation is mainly established at the initial stage of the primary ageing treatment, it is essential to precisely control the heat treatment conditions at this particular initial stage, and to this end, it is preferable to reduce a charging ratio of the alloy material into the furnace to a minimum practical level, and conduct the heat treatment on a limited quantity of the alloy material. When applying the secondary ageing treatment on the material in succession, however, it is inefficient and uneconomical from the viewpoint of industrial scale production to carry on the furnace operation under such low a charging ratio for a long period of time. On the other hand, for the secondary ageing treatment, it is possible to carry on the furnace operation with a higher charging ratio, as the heat treatment conditions thereof are more moderate and not critical. In order to solve this problem, it is advantageous in practice, to previously conduct the process of the primary ageing, namely the step of establishing the geometric factor in the two-phase separation, on a plurality of production lots of alloy material, and cool them once down to or near the ambient temperature, and then conduct the secondary ageing treatment upon the desired quantity of material lots at a time to meet industrial efficiency and economy. This batch type operation is an effective compromise to maintain the desired rate of mass production within a given period of time while meeting the efficiency requirements in the furnace operation.

As is apparent from the foregoing detailed description, this invention advantageously provides, on the one hand, an improved Fe/Cr/Co magnet alloy which is particularly of such features as to contribute to a reduction in natural resources consumption, which contains less cobalt content, thus providing a good workability, and moreover, makes best use of the characteristics of the component compositions of such an alloy, and on the other hand, an improved method of producing the magnet alloy (including a semi-hard magnet alloy) of the above mentioned character, which is particularly advantageous from the industrial productivity and which can make best use of the excellent properties of the component compositions.

What is claimed is:

1. A method of producing a Fe/Cr/Co permanent magnet alloy consisting essentially of 17 to 45% by weight chromium, 3.0 to 14.9% by weight cobalt and the remainder being iron, by subjecting the alloy to a two-step aging treatment, whereby a two-phase structure of the alloy is precipitated, which two-step aging treatment comprises:

a step of primary aging treatment of heating the alloy to a temperature within the range of 590° to 670° C. and maintaining the alloy at said temperature in a controlled magnetic field, whereby said two-phase structure is formed, with the anisotropy in one of the two phases being oriented along the direction of the applied magnetic field;

cooling the alloy at a sufficiently rapid cooling rate, down to a temperature lower than that temperature predetermined for starting subsequent secondary aging treatment, such that further precipitation of two-phase structure of the alloy is substantially prevented from taking place; and a secondary aging treatment of heating the alloy to a temperature predetermined for starting which is lower at least by 10° C. than the temperature in the primary aging treatment and then subjecting the alloy to a slow and continuous cooling at a rate of temperature decrement of 100° C. over 2 to 50 hours down to a temperature lower than 560° C., thereby to widen the composition difference between the previously separated two phases due to said primary aging treatment.

2. The method as claimed in claim 1 wherein said temperature predetermined for starting said secondary aging treatment is lower by 15° C. to 60° C. than said temperature in the primary aging treatment.

3. The method as claimed in claim 1 wherein an intensity of said controlled magnetic field for said primary aging treatment is 2500 Oe or higher, and said temperature of said primary aging treatment ranges from 610° to 650° C.

4. The method as claimed in claim 1, wherein the alloy is cooled at said sufficiently rapid cooling rate, after said primary aging treatment, by open-air natural cooling, at a cooling rate determined by ambient temperature.

5. The method as claimed in claim 1, wherein said two-phase structure has a ferromagnetic phase and an inferior ferromagnetic phase, and wherein said one of the two phases being oriented along the direction of the applied magnetic field is said ferromagnetic phase.

6. The method as claimed in claim 5, wherein the volumetric ratio of ferromagnetic phase to inferior ferromagnetic phase is approximately 1 to 1.

7. The method as claimed in claim 5, wherein said controlled magnetic field has an intensity of at least 500 Oe.

8. The method as claimed in claim 5, wherein said controlled magnetic field has an intensity of at least 1000 Oe.

9. The method as claimed in claim 1, wherein the alloy is maintained at said temperature in a controlled magnetic field for at least 30 minutes.

10. The method as claimed in claim 1, wherein said temperature predetermined for starting the secondary aging treatment is 10°-80° C. lower than the temperature in the primary aging treatment.

11. The method as claimed in claim 1, wherein the alloy is subjected to a slow and continuous cooling in the secondary aging treatment down to a temperature lower than 520° C.

12. The method as claimed in claim 4, wherein the alloy is subjected to a slow and continuous cooling in the secondary aging treatment down to a temperature lower than 500° C.

13. The method as claimed in claim 4, wherein the alloy is cooled after the primary aging treatment at a rate of temperature decrement of 100° C. in two hours or less.

14. The method as claimed in claim 13, wherein the rate of temperature decrement of cooling the alloy after the primary aging treatment is 100° C. in 30 minutes or less.

* * * * *

UNITED STATES PATENT AND TRADEMARK OFFICE

CERTIFICATE OF CORRECTION

PATENT NO. : 4,194,932
DATED : March 25, 1980
INVENTOR(S) : Masao Iwata

It is certified that error appears in the above—identified patent and that said Letters Patent is hereby corrected as shown below:

On The Title Page: change the Assignee from "Hitachi Metals, Japan" to --Hitachi Metals, Ltd., Japan--.

Signed and Sealed this

*Ninth* Day of *June 1981*

[SEAL]

*Attest:*

RENE D. TEGTMEYER

*Attesting Officer* *Acting Commissioner of Patents and Trademarks*